US007618035B2

(12) United States Patent
Koga et al.

(10) Patent No.: US 7,618,035 B2
(45) Date of Patent: Nov. 17, 2009

(54) IMAGE RECORDING APPARATUS

(75) Inventors: Yuji Koga, Nagoya (JP); Keisuke Wakakusa, Nagoya (JP)

(73) Assignee: Brother Kogyo Kabushiki Kaisha, Nagoya-shi-, Aichi-ken (JP)

( * ) Notice: Subject to any disclaimer, the term of this patent is extended or adjusted under 35 U.S.C. 154(b) by 0 days.

(21) Appl. No.: 11/964,477

(22) Filed: Dec. 26, 2007

(65) Prior Publication Data

US 2008/0150217 A1 Jun. 26, 2008

(30) Foreign Application Priority Data

Dec. 26, 2006 (JP) ..... 2006-349783

(51) Int. Cl.
*B65H 3/44* (2006.01)

(52) U.S. Cl. ..... 271/9.11; 271/9.01; 271/9.13

(58) Field of Classification Search ..... 271/9.01, 271/9.11, 9.13, 162, 163, 223
See application file for complete search history.

(56) References Cited

U.S. PATENT DOCUMENTS

| | | | | |
|---|---|---|---|---|
| 4,131,274 | A * | 12/1978 | Sue | 271/9.11 |
| 6,022,013 | A * | 2/2000 | Foglino et al. | 271/9.08 |
| 6,390,466 | B1 * | 5/2002 | Sanmiya | 271/213 |
| 6,561,506 | B2 * | 5/2003 | Sasaki et al. | 271/145 |
| 2005/0104280 | A1 * | 5/2005 | Wong et al. | 271/162 |
| 2005/0225025 | A1 * | 10/2005 | Chikumoto | 271/162 |
| 2006/0163796 | A1 * | 7/2006 | Shiohara et al. | 271/9.01 |
| 2006/0261535 | A1 * | 11/2006 | Shiohara et al. | 271/9.01 |
| 2007/0075476 | A1 * | 4/2007 | Shiohara | 271/9.01 |
| 2007/0176354 | A1 * | 8/2007 | Shiohara | 271/162 |
| 2007/0182083 | A1 * | 8/2007 | Asada et al. | 271/9.01 |

FOREIGN PATENT DOCUMENTS

| | | | |
|---|---|---|---|
| JP | 61188336 | * | 8/1986 |
| JP | 2000072260 | A | 3/2000 |
| JP | 2006273564 | A | 10/2006 |
| JP | 2006273565 | A | 10/2006 |
| JP | 2006273567 | A | 10/2006 |

* cited by examiner

*Primary Examiner*—Patrick H MacKey
*Assistant Examiner*—Patrick Cicchino
(74) *Attorney, Agent, or Firm*—Baker Botts, LLP

(57) ABSTRACT

One aspect of the invention provides an image recording apparatus including: an image recording unit; a first sheet feeding cassette; a second sheet feeding cassette including a second placing portion and a discharged sheet placing portion disposed an upstream side of a second placing portion with respect to the first direction; a sheet feed unit configured to feed the recording medium; an auxiliary cover member disposed above the second placing portion; and an auxiliary sheet discharging tray disposed below the discharged sheet placing portion. A sheet insertion opening is formed between an upstream end of the cover member and the discharged sheet placing portion and communicates with the second sheet placing portion. The auxiliary sheet discharging tray is movable in a forward direction and a rearward direction opposite to the forward direction, with respect to the sheet insertion opening.

16 Claims, 10 Drawing Sheets

IMAGE RECORDING APPARATUS

CROSS-REFERENCE TO RELATED APPLICATIONS

This application is based upon and claims the benefit of priority from Japanese Patent Application No. 2006-349783, filed on Dec. 26, 2006, the entire contents of which are incorporated herein by reference.

TECHNICAL FIELD

One aspect of the present invention relates to an image recording apparatus with main and auxiliary sheet feeding cassettes capable of facilitating a sheet setting operation to the auxiliary sheet feeding cassette.

BACKGROUND

As an example of image recording apparatuses such as various types of printers or facsimile machines, JP-A-2006-273567 (FIGS. 4 to 11) discloses an image recording apparatus in which sheets (recording media or cut sheets) stacked substantially horizontally are placed on a placing portion of a first sheet feeding cassette (a main cassette) disposed at the lower portion in a body (housing) of the apparatus. A second sheet feeding cassette (an auxiliary sheet feeding cassette) serving as a sub-cassette is disposed above the placing portion movable back and forth with respect to the first sheet feeding cassette. Small-sized sheets are stacked on a placing portion of the second sheet feeding cassette.

On the main unit side, a common feed roller is disposed near an inclined separation portion at the front of the first sheet feeding cassette on the upper-surface side thereof. A sheet fed by the common feed roller is upwardly guided at the inclined separation portion, is then conveyed to the undersurface of a recording head (recording unit) via a curved conveying path with substantially U-shape (when viewed from cross section) and which is disposed above the inclined separation portion, is then subjected to a recording operation, and is discharged toward the front of the apparatus body.

In this apparatus, the second sheet feeding cassette is moved back and forth to select the first sheet feeding cassette or the second sheet feeding cassette from which sheets are conveyed one by one toward the recording unit by means of the common feed roller.

The second sheet feeding cassette additionally has a discharged-sheet receiving portion disposed reward the sheet-setting portion. The placing portion of the first sheet feeding cassette includes rear-end and side-end guide members that are movably disposed and determine the position in which a large-sized sheet is set. The sheet-setting portion of the second sheet feeding cassette has rear-end and side-end guide members that are movably disposed and determine the position in which a small-sized sheet is set.

SUMMARY

However, according to the structure disclosed in JP-A-2006-273567, both of the first and second sheet feeding cassettes are pulled out from the apparatus body in order to stack and set predetermined sheets. When sheets are set in the first sheet feeding cassette (main sheet feeding cassette), the following operations are performed: detaching the second sheet feeding cassette (auxiliary sheet feeding cassette); moving the rear-end and side-end guide members; stacking the sheets in the space of the placing portion; and re-setting the guide members. Likewise, when sheets are set in the second sheet feeding cassette, the following operations are performed: moving the rear-end and side-end guide members; stacking a plurality of sheets in the space of the sheet stacking portion; and re-setting the guide member.

The sheet discharging tray may be formed integrally to and rearward the sheet stacking portion of the second sheet feeding cassette and a roof portion may be contiguously formed at the upper end of the side-end guide member (e.g., above the sheet stacking portion), so that a recorded sheet can guided toward a sheet discharging tray without allowing the recorded sheet to lie on a unrecorded sheet placed in the sheet stacking portion. Especially in this case, since the roof portion is an impediment when sheets are set, sheets have to be inserted from an end of the second sheet feeding cassette on the downstream side in the feed direction, which takes much effort to replenish the second sheet feeding cassette with sheets.

One aspect of the present invention has an object to provide an image recording apparatus capable of easily setting sheets (recording media) with a relatively simple structure.

According to an aspect of the invention, there is provided an image recording apparatus including: an image recording unit configured to record an image on a recording medium; a first sheet feeding cassette disposed below the image recording unit and movable substantially along a first direction, the first sheet feeding cassette comprising a first placing portion on which a recording medium is allowed to be placed; a second sheet feeding cassette disposed on and attached to the first sheet feeding cassette and movable substantially along the first direction with respect to the first sheet feeding cassette, the second sheet feeding cassette comprising: a second placing portion on which a recording medium is allowed to be placed; and a discharged sheet placing portion disposed an upstream side of the second placing portion with respect to the first direction; a sheet feed unit configured to selectively feed the recording medium placed in the first sheet feeding cassette and the second sheet feeding cassette in the first direction toward the image recording unit via a sheet conveying path; an auxiliary cover member disposed above the second placing portion, on which the recording medium discharged from the image recording unit is allowed to be placed; and an auxiliary sheet discharging tray that is disposed below the discharged sheet placing portion, wherein a sheet insertion opening is formed between an upstream end of the cover member with respect to the first direction and the discharged sheet placing portion and communicates with an upstream side of the second placing portion with respect to the first direction, and wherein the auxiliary sheet discharging tray is movable in a forward direction and a rearward direction opposite to the forward direction, with respect to the sheet insertion opening.

DESCRIPTION

Next, an illustrative aspect of the present invention will be described with reference to the drawings.

This illustrative aspect shows an image recording apparatus in which the present invention is applied to a multifunction device (MFD) 1 having a printer function, a copy function, a scanner function, a facsimile function, and a cordless telephone function. The multifunction device 1 can be connected to computers (not shown) or to telephone communication networks (not shown), and can record images or documents on a sheet (cut sheet), which is an example of recording medium, based on image data or document data transmitted from these computers or other facsimile machines. Additionally, the multifunction device 1 can be connected to an external apparatus, such as a digital camera, and can record image data output from the digital camera on a sheet.

Figure 1:
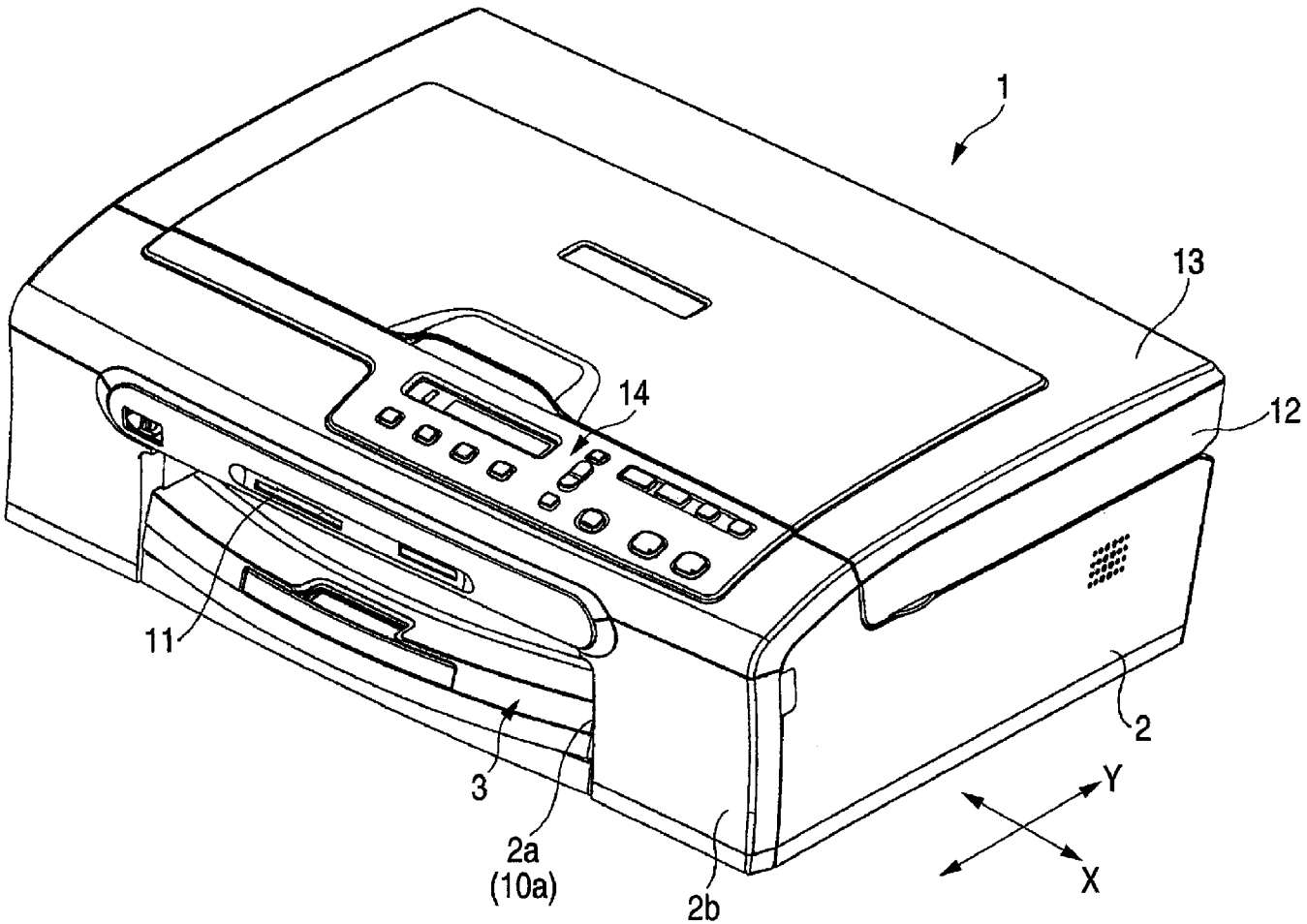
FIG. 1 is a perspective view of an image recording apparatus according to an illustrative aspect of the present invention.

As shown in FIG. 1, in this illustrative aspect, an image recording unit (hereinafter, referred to simply as a "recording unit") 7 is disposed at the lower portion of a casing (housing) 2 made of, e.g., synthetic resin. A main sheet feeding cassette 3 (an example of a first sheet feeding cassette) is disposed which can be (substantially horizontally) inserted into and extracted from a cassette storage portion (a storage space) located on the bottom of the casing 2 serving as an apparatus body through an insertion opening 2*a* formed in the front of the casing 2. As is described later, an auxiliary sheet feeding cassette 30 (an example of a second sheet feeding cassette) capable of stacking therein a plurality of small-sized sheets is disposed on the upper surface of the main sheet feeding cassette 3 to be movable back and forth.

A slot unit 11 is provided at the front side (i.e., side where the insertion opening 2*a* is formed) of the casing 2. It is also possible to record image data or the like stored in one of various storage media, such as a memory card, by inserting such a storage medium into the slot unit 11.

An image reader (scanner unit) 12 used to read a document or the like in a copy function or a facsimile function is disposed in an image-reading unit case 12*a* at the upper portion of the casing 2.

An operation panel unit 14 including various operation buttons and a liquid crystal display is provided in front of the image reader 12 at the upper portion of the casing 2. A recording unit 7, a sheet discharge portion 10, etc., are disposed within a projected area of the image reader 12 and the operation panel unit 14 when viewed from the top. A built-in-type storage portion 15 for ink cartridges is disposed at one side (i.e., right side in FIG. 1) of the sheet discharge portion 10 at the front of the casing 2. The front side of the storage portion 15 is covered with a lid 2*b* that can be opened and closed on a hinge provided at its lower end while being rotated upwardly and downwardly at the front of the casing 2. The ink storage portion 15 accommodates ink cartridges 19 for four colors (black, cyan, magenta, and yellow). The ink is supplied from ink cartridges 19 to recording head 4 though a plurality of ink tubes 20 for each color.

A document-setting glass plate 16 on which a document can be placed and set is provided on the upper surface of the image reader 12. An image scanner (CIS: Contact Image Sensor) 17 used to read a document is provided under the glass plate 16 so that the sensor can reciprocate along a shaft 56 extending in a direction perpendicular to the sheet plane of FIG. 3 (i.e., in a main scanning direction, which is hereinafter referred to as an "X-axis direction").

Figure 3:
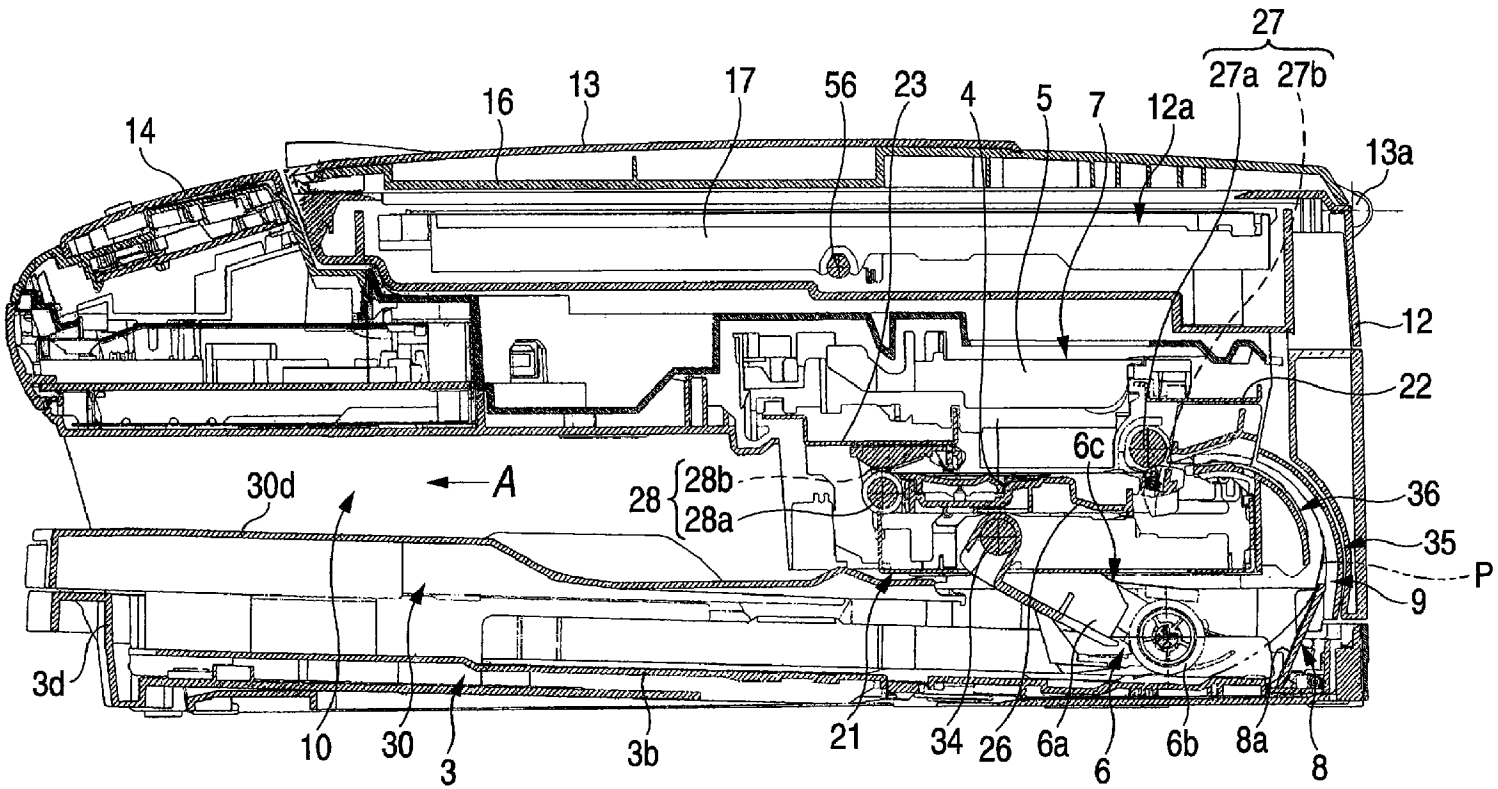
FIG. 3 is a cross-sectional view of the image recording apparatus according to the illustrative aspect of the present invention.

A document-covering body 13 with which the glass plate 16 is covered is attached to the image-reading unit case 12*a* so as to be opened and closed on a hinge 13*a* provided at its rear end (i.e., right side in FIG. 3).

Figure 2:
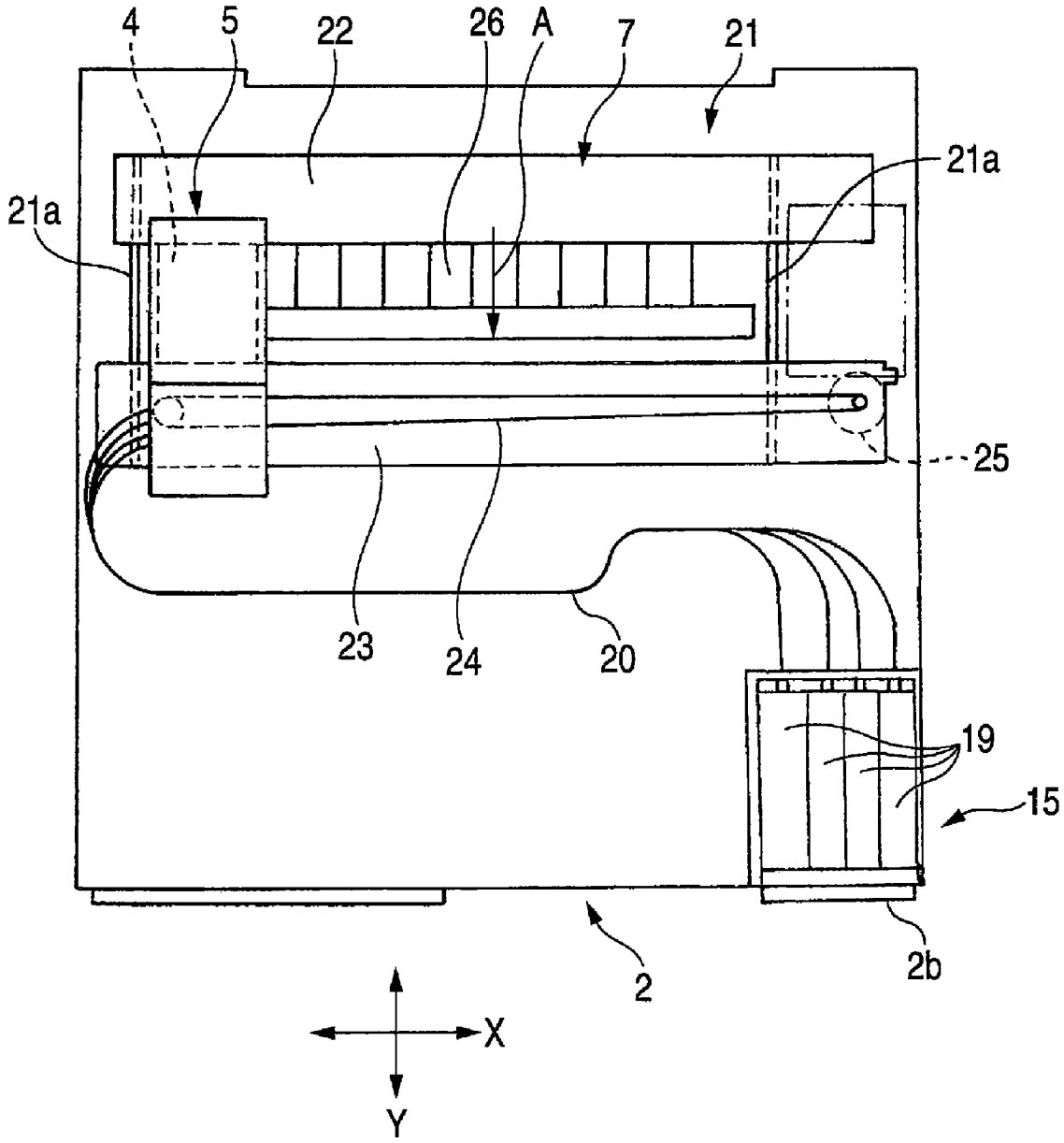
FIG. 2 is a plan view showing a recording unit and other elements.

As shown in FIG. 2 and FIG. 3, the recording unit 7 is supported by a pair of right and left side plates 21*a* in a main frame 21 that is formed in a rectangular shape and whose upper surface is opened. The recording unit 7 includes first and second guide members 22 and 23 each of which is formed in an oblong, tabular (plate-like) shape extending in the X-axis direction (i.e., in the main scanning direction), a reciprocatably-formed carriage 5 that is slidably supported (mounted) while stretching over both the guide members 22 and 23, a timing belt 24 that is an endless belt wound on a pulley on the upper surface of the second guide member 23 in parallel with the second guide member 23 so that the carriage 5 on which the recording head 4 is mounted can be reciprocated, a CR (carriage) motor 25 that drives the timing belt (which may be replaced by another motor, such as a stepping motor, although a DC motor is used in this illustrative aspect), a tabular platen 26 that supports a sheet being conveyed on the undersurface side of the recording head 4, and a tape scale (not shown) that is disposed extending in the main scanning direction and that is a component of an optical linear encoder used to detect the position in the X-axis direction of the carriage 5 and the moving speed in this direction. The first guide member 22 is disposed on the upstream side in a sheet-conveying direction in the direction in which a sheet passes on the platen 26 (i.e., on the upstream side in the direction of arrow A, see FIG. 3), whereas the second guide member 23 is disposed on the downstream side in the sheet-conveying direction.

A registration roller pair 27 used both for a conveying action and for a registration action is disposed on the upstream side in the sheet-conveying direction with respect to the platen 26. The registration roller pair 27 including a driving roller 27*a* and a driven roller 27*b* serves to convey a sheet to a gap between the nozzle surface of the undersurface of the recording head 4 and the platen 26. A discharge unit 28 is disposed on the downstream side in the sheet-conveying direction with respect to the platen 26, and the discharge unit includes: a spur 28*b* contacting with the top side of a sheet; and a discharge roller 28*a* contacting with the bottom side thereof while driving the sheet. The discharge roller 28*a* and the spur 28*b* convey a recorded sheet toward the sheet discharge portion 10 that is a space defined on the upper side of the auxiliary sheet feeding cassette 30 described later.

A feed roller 6*b* used as a sheet feed unit 6 is disposed on the side of the casing 2. In detail, a drive shaft 34 is provided at the upper end of a sheet feed arm 6*a* in the sheet feed unit. The sheet feed arm 6*a* is rotatably disposed upwardly and downwardly on the drive shaft 34. As a result of cooperation between the feed roller 6*b* disposed at the lower end of the sheet feed arm 6*a* and an inclined separation plate 8, sheets P (P1) that are recording media stacked in the main sheet feeding cassette 3 and in the auxiliary sheet feeding cassette 30 are separated one by one, and are conveyed.

In more detail, the synthetic-resin-made drive shaft 34 shown in FIG. 3 is inserted into shaft holes formed in a side plate (not shown) in the main frame 21 and a pair of shaft support plates (not shown), respectively, so as to be rotatably supported and so as to allow an end of the drive shaft 34 to sideways project toward the base of the sheet feed arm 6*a* in the sheet feed unit. The feed roller 6*b* is rotated in a constant direction (i.e., counterclockwise in FIG. 3) by the rotation and driving of the drive shaft 34 through a gear drive mechanism 6*c* provided in the sheet feed arm 6*a*. Further, a downward urging force is given by an urging member (e.g., a torsion spring) not shown.

Sheets divided one by one are fed to the recording unit 7 provided above (higher than) the main sheet feeding cassette 3 via a conveying path body used for an sideward U-turn path (fed-sheet conveying path) 9 structured as described later. A sheet having been recorded by the recording unit 7 is discharged in a state in which a recorded surface of the sheet is directed upwardly.

As shown in FIG. 3, a conveying path body to form a fed-sheet conveying path (U-turn path) 9 for the main and auxiliary sheet feeding cassettes 3 and 30 is made up of an outer-diameter conveying path body 35 that is a sidewise, U-shaped path body when viewed from the side and an inner-diameter conveying path body 36 that is disposed radially inside the outer-diameter conveying path body 35 with a predetermined gap between the inner and outer diameter conveying path bodies 36 and 35. Both the outer-diameter conveying path body 35 and the inner-diameter conveying path body 36 are, for example, injection molded articles made of synthetic resin. A detection lever (not shown), which is used for a sensor detecting the presence or absence of a sheet and which extends radially outwardly from radially inside the inner-diameter conveying path body 36, is rotatably disposed on the downstream side of the fed-sheet conveying path (U-turn path) 9. The detection lever enables the sensor to detect that the leading end and the tail end of a sheet passing through the fed-sheet conveying path (U-turn path) 9 have passed.

In this illustrative aspect, the side on which the inclined separation plate 8 of the main sheet feeding cassette 3 is disposed (in other words, with respect to the auxiliary sheet feeding cassette 30, the side nearer to the inclined separation plate 8) will be hereinafter referred to as the "front side (forward end portion)" or as the "downstream side in the sheet-feed direction," whereas the opposite side will be hereinafter referred to as the "rear side (rear end portion)" or as the "upstream side in the sheet-feed direction." Additionally, the movement of the main sheet feeding cassette 3 from outside the apparatus body 2 inwardly will be referred to as "forward" or as "insertion," whereas the opposite movement will be referred to as "backward" or as "extraction." As shown in FIG. 3, FIG. 4, and FIG. 6, the main sheet feeding cassette 3 includes a placing portion 3*a* that can store a plurality of large-sized cut sheets P, such as A4-size, letter-size, or legal-size sheets, serving as recording media accumulated (stacked) in such a way that the short side of the sheet extends in an X-axis direction (i.e., in a direction perpendicular to the sheet plane of FIG. 3 or in a main scanning direction). The placing portion 3*a* is formed in a space enclosed by right and left side plates 3*c* and 3*c*, a bottom plate 3*b*, the inclined separation plate 8, and a rear plate 3*d* that is disposed on the rear end side and that can also be used as a handle.

The auxiliary sheet feeding cassette 30 including a sheet-setting portion 30*a* in which a plurality of small-sized sheets P1, such as postcards, 4-inches-by-6-inches sheets, or L-size sheets (see FIG. 6 to FIG. 10), can be stacked and stored is attached to the upper portion of the main sheet feeding cassette 3 so as to be movable in a Y-axis direction (i.e., in a sheet-conveying direction or in a sub-scanning direction) In this example, the right and left side ends of the bottom plate 30*b* of the auxiliary sheet feeding cassette 30 are brought into slidable contact with the upper end surfaces of the right and left side plates 3*c* and 3*c* of the main sheet feeding cassette 3, and, as a result, the auxiliary sheet feeding cassette 30 can be moved.

The inclined separation plate 8 used to separate sheets one by one is disposed on the depth side of the main sheet feeding cassette 3 (i.e., on the forward end side, the downstream side in the sheet-feed direction, or the right side in FIG. 3). An elastic separation pad 8*a* serving as a separating member (in this illustrative aspect, a plate-spring-made pad) is provided on the inside (surface) of a central portion in the width direction (X-axis direction) of the inclined separation plate 8.

A pair of right and left side guide members 31 that guide a side track in parallel with the sheet-feed direction (an example of a first direction) in a contact manner and that perform the centering in the sheet-feed direction of a sheet are disposed in the placing portion 3*a* of the main sheet feeding cassette 3 so that the side guide members 31 can be widely or narrowly moved (slid) in a direction perpendicular to the sheet-feed direction with respect to the bottom plate 3*b*. A guide member (not shown) for positioning the leading end of a sheet placed on the placing portion 3*a* is additionally provided so as to be movable forwardly and backwardly.

The auxiliary sheet feeding cassette 30 is configured to be rotatable so that the rear portion of the main sheet feeding cassette 3 is greatly opened upwardly. That is, the rear portion of the auxiliary sheet feeding cassette 30 can be lifted to expose the placing portion 3*a* of the main sheet feeding cassette 3. Accordingly, the placing portion 3*a* of the main sheet feeding cassette 3 can be replenished with large-sized sheet P while lifting the rear end of the auxiliary sheet feeding cassette 30.

Therefore, when the auxiliary sheet feeding cassette 30 is in a non-sheet-feed position (i.e., position to which the cassette is pulled out leftwardly in FIG. 3, FIG. 4, FIG. 6, and FIG. 9) with respect to the main sheet feeding cassette 3, the feed roller 6*b* is placed to approach the bottom plate 3*b* of the main sheet feeding cassette 3, so that sheets can be set into the placing portion 3*a* of the main sheet feeding cassette 3. Preferably, sheets are set thereinto in a state where at least a rear portion of the main sheet feeding cassette 3 and a rear portion of the auxiliary sheet feeding cassette 30 is pulled out from the insertion portion 2*a*.

In contrast with the above example, when the auxiliary sheet feeding cassette 30 is pushed into the depth side of the main sheet feeding cassette 3 so as to take a sheet feed position in which two small projections 30*e* formed on the forward end of the auxiliary sheet feeding cassette 30 are fitted to the inclined separation plate 8 of the main sheet feeding cassette 3 as shown in FIG. 8 and FIG. 10, the feed roller 6*b* is disposed to face the bottom plate 30*b* of the auxiliary sheet feeding cassette 30, and sheets P1 placed and set in the auxiliary sheet feeding cassette 30 can be fed as described later.

The sheet stacking portion 30*a* of the auxiliary sheet feeding cassette 30 is formed in a concave shape in the bottom plate 30*b* at a central portion between the right and left side plates 30*c* and 30*c*. A discharged-sheet placing portion (sheet discharging tray) 30*d* (see FIG. 3, FIG. 4A, and FIG. 4B), on which discharged sheets are placed, is disposed at an area surrounding the rear side and the right and left sides of the sheet stacking portion 30*a* and has a flat plate with C-shape when viewed from the top which is connected to the upper ends of the right and left side plates 30*c* and 30*c*. Therefore, the discharged-sheet placing portion (sheet discharging tray) 30*d* includes side placing portions 30*d*1 and 30*d*1 located outside the right and left sides of the sheet stacking portion 30*a* and a center placing portion 30*d*2 located at the rear side of the sheet stacking portion 30*a*. The forward end of the auxiliary sheet feeding cassette 30 (downstream side in the sheet-feed direction) is in an open state, and the two small projections 30*e* ahead thereof are used as a positioning member that are fitted to recesses formed in the inclined separation plate 8.

Figure 4A:
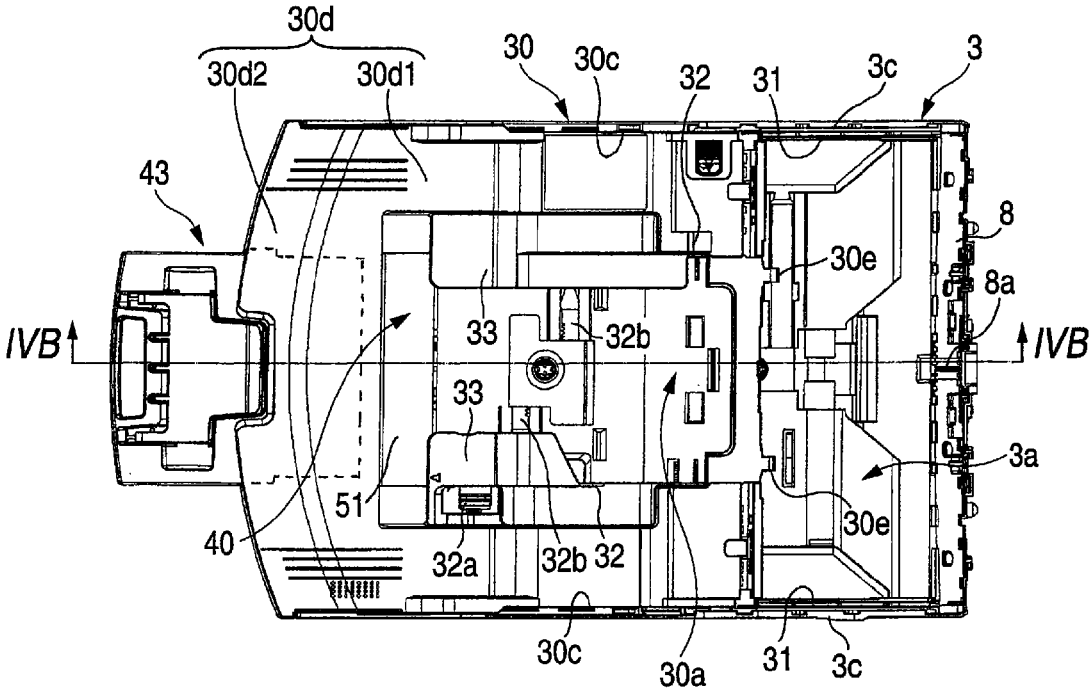
FIG. 4A is a plan view showing a main sheet feeding cassette and an auxiliary sheet feeding cassette carried backward therefrom without sheets P (P1)
Figure 4B:
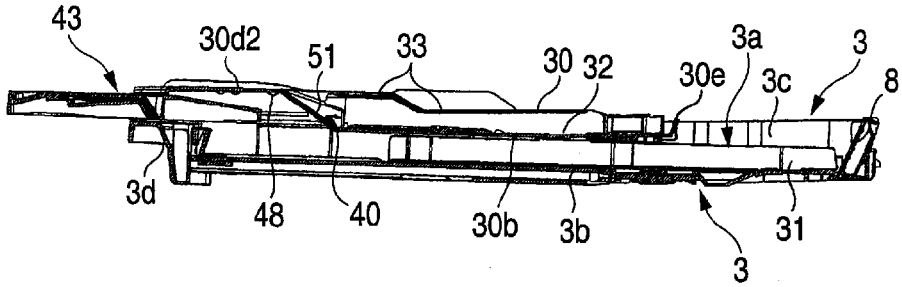
FIG. 4B is a cross-sectional view along line IVb-IVb of FIG. 4A.
Figure 4C:
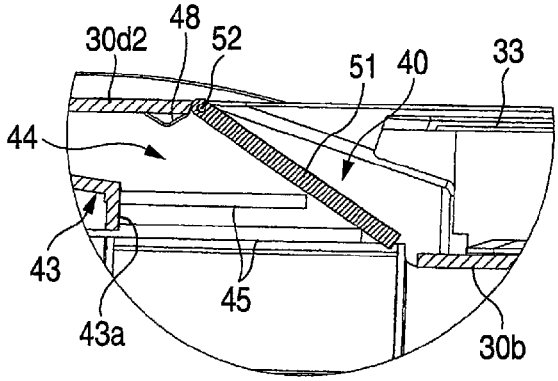
FIG. 4C is an enlarged cross-sectional view of the main part of FIG. 4B.

A pair of right and left side guide members 32 that guide a side track in parallel with the feed direction of a sheet P1 in a contact manner and that perform the centering in the feed direction of a sheet P1 are disposed in the sheet stacking portion 30*a* so that the side guide members 32 can be widely or narrowly moved (slid) in a direction perpendicular to the feed direction of a sheet P1 with respect to the bottom plate 30*b*. A rack body 32*b* contiguous to the bottom of the right and left side guide members 32 is formed to be engaged with a gear (not shown) provided at a central portion in the width direction of the bottom plate 30*b*. One of the side guide members 32 has a knob 32*a* that can mesh with and hold an engagement portion in a position to which the pair of side guide members 32 moved in the width direction of a sheet P1. The same applies to the structure of the pair of right and left side guide members 31 mentioned above. FIG. 4A, FIG. 4B, and FIG. 4C show an empty state in which no sheet P1 is placed on the sheet stacking portion 30*a* and a positional state in which the auxiliary sheet feeding cassette 30 has been carried backward from the main sheet feeding cassette 3.

Auxiliary cover portions 33 each of which is shaped like a flat roof, with which both the right and left portions of the upper side of each sheet P1 stacked in the sheet stacking portion 30*a* are covered, are additionally provided at the upper ends of the pair of right and left side guide members 32, respectively. Each auxiliary cover portion 33 is formed long along the feed direction of a sheet P1. An end portion (rear end side) on the upstream side in the feed direction of the sheet P1 of each auxiliary cover portion 33 is formed to be positionally slightly higher than the other portion thereof on the downstream side, and is formed to occupy substantially the same height position as the height position of the center placing portion 30*d*2 of the discharged-sheet placing portion (sheet discharging tray) 30*d* (see FIG. 4B, FIG. 4C, FIG. 7A, FIG. 7B, FIG. 8A, and FIG. 8B, for example). A sheet P (P1) is slid on the upper surface of the auxiliary cover portion 33 while being discharged, and the forward end in the discharged direction of the sheet P (P1) is guided onto the center placing portion 30*d*2.

A sheet insertion opening 40 that communicates with the inside of the sheet stacking portion 30*a* is formed between an end (rear end) on the upstream side in the sheet-feed direction of the sheet stacking portion 30*a* and a forward end of the center placing portion 30*d*2 of the discharged-sheet placing portion 30*d* (see FIG. 4A to FIG. 4C). Therefore, a user can insert a bundle of small-sized sheets P1, such as postcards, 4-inches-by-6-inches sheets, or L-size sheets, from the upper surface side of the center placing portion 30*d*2 into the sheet stacking portion 30*a* through the sheet insertion opening 40, and can stack these sheets. Preferably, these sheets are supplied such that the auxiliary sheet feeding cassette 30 is pulled out together with the main sheet feeding cassette 3 so that the auxiliary sheet feeding cassette 30 comes out from the insertion opening 2*a* outside the casing 2 when the main sheet feeding cassette 3 and the auxiliary sheet feeding cassette 30 have been inserted in the casing 2. More preferably, the sheet insertion opening 40 in the auxiliary sheet feeding cassette 30 is at least outside the casing 2. The reason is that hands of the user can easily reach the sheet stacking portion 30*a*. Additionally, the sheet-supplying operation is performed in a state in which an auxiliary sheet discharging tray 43 described later has been carried backward (i.e., in a state in which the opening area of the sheet insertion opening 40 has been greatly opened).

Figure 5A:
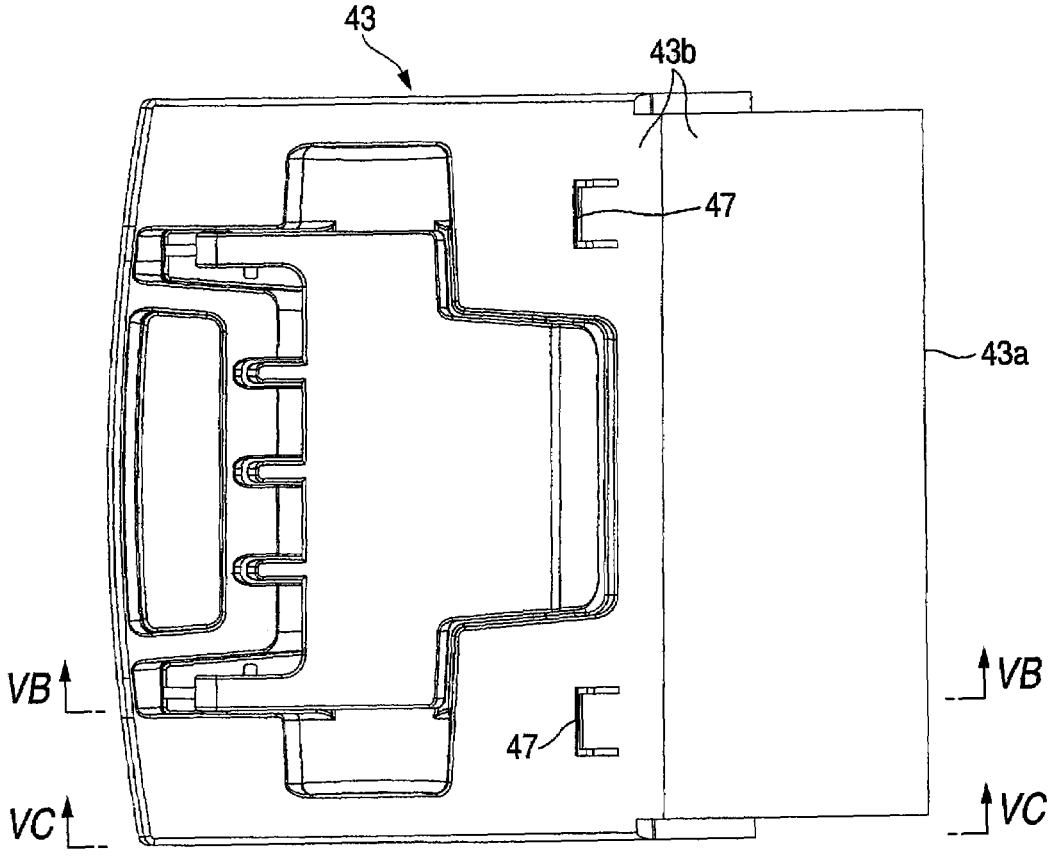
FIG. 5A is a plan view of an auxiliary sheet discharging tray.
Figure 5B:
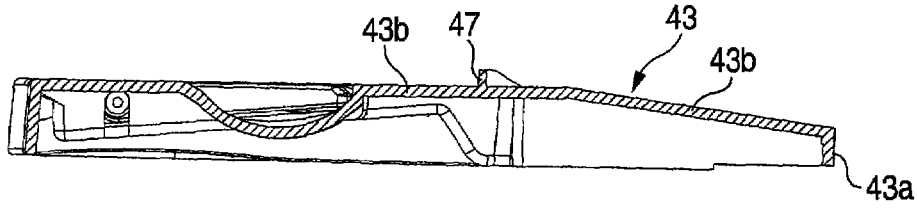
FIG. 5B is a cross-sectional view along line Vb-Vb of FIG. 5A.
Figure 5C:
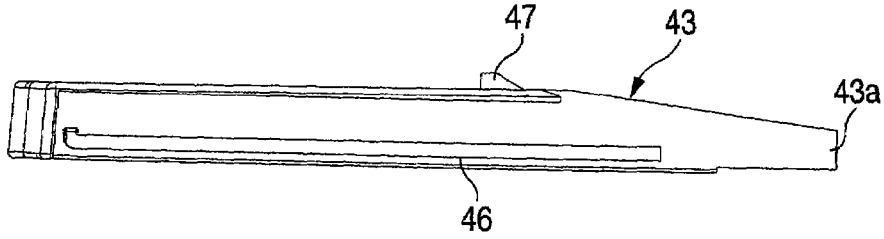
FIG. 5C is a side view along line Vc-Vc of FIG. 5A.

The auxiliary sheet discharging tray 43 shown in FIG. 5A to FIG. 5C is disposed in a downwardly-open hollow portion 44 (see FIG. 4C) formed on the undersurface of the center placing portion 30*d*2 so as to be movable forwardly and backwardly. In this illustrative aspect, guide portions 46 extended in a back and forward direction on the side face of the auxiliary sheet discharging tray 43 are slidably fitted to rails 45 (see FIG. 4C) extended in a back and forward direction at both the right and left sides of the hollow portion 44, respectively.

Figure 6A:
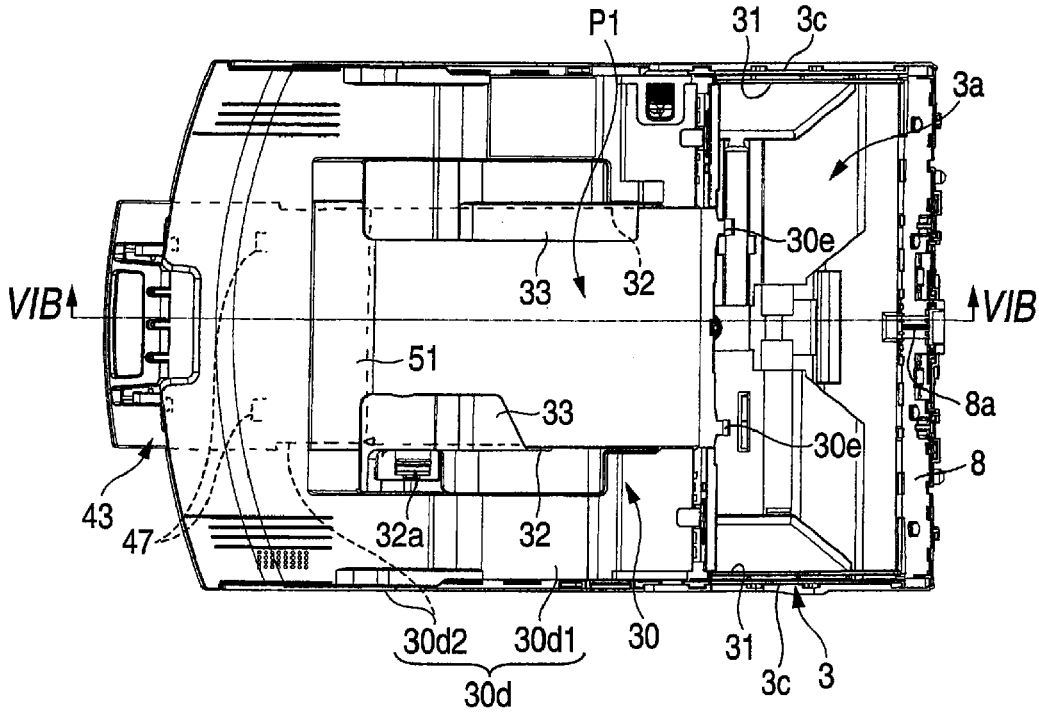
FIG. 6A is a plan view showing a state in which 4-inches-by-6-inches sheets P1 have been set in the auxiliary sheet feeding cassette carried backward from the main sheet feeding cassette.
Figure 6B:
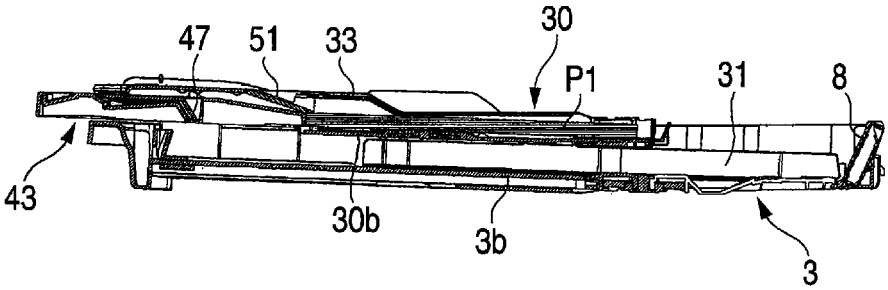
FIG. 6B is a cross-sectional view along line VIb-VIb of FIG. 6A.
Figure 6C:
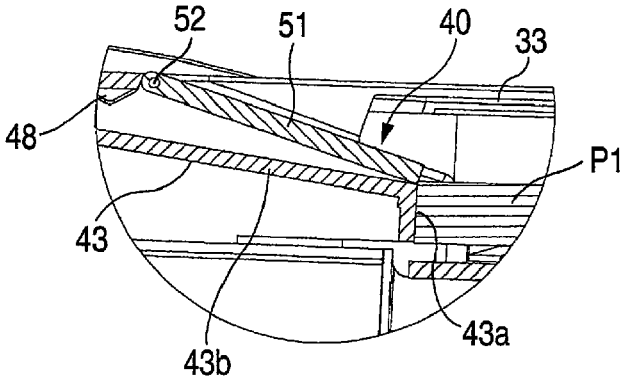
FIG. 6C is an enlarged cross-sectional view of the main part of FIG. 6B.

As shown in FIG. 6A to FIG. 6C, when 4-inches-by-6-inches sheets P1 are supplied, the auxiliary sheet discharging tray 43 is carried backward so as to open the sheet insertion opening 40 in the auxiliary sheet feeding cassette 30 in a state in which the auxiliary sheet feeding cassette 30 has been pulled up to the rear end of the main sheet feeding cassette 3 (i.e., in a non-sheet-feed state). Under this state, a sheet P1 that has been slid on the center placing portion 30*d*2 of the discharged-sheet placing portion 30*d* is inserted from the sheet insertion opening 40 into the sheet stacking portion 30*a*. A bundle of predeterminedly-sized sheets P1 is then inserted into the sheet stacking portion 30*a*, and the auxiliary sheet discharging tray 43 is carried forward. As a result, a forward end plate 43*a* of the auxiliary sheet discharging tray 43 comes into contact with the tail end of the sheet P1. Therefore, the auxiliary sheet discharging tray 43 serves as a rear end guide for the sheet P1, thus preventing the sheet P1 from moving backwardly. Thereafter, positions of the right and left side tracks of the sheet P1 are determined while grasping and adjusting the knob 32*a* of the side guide member 32.

Figure 7A:
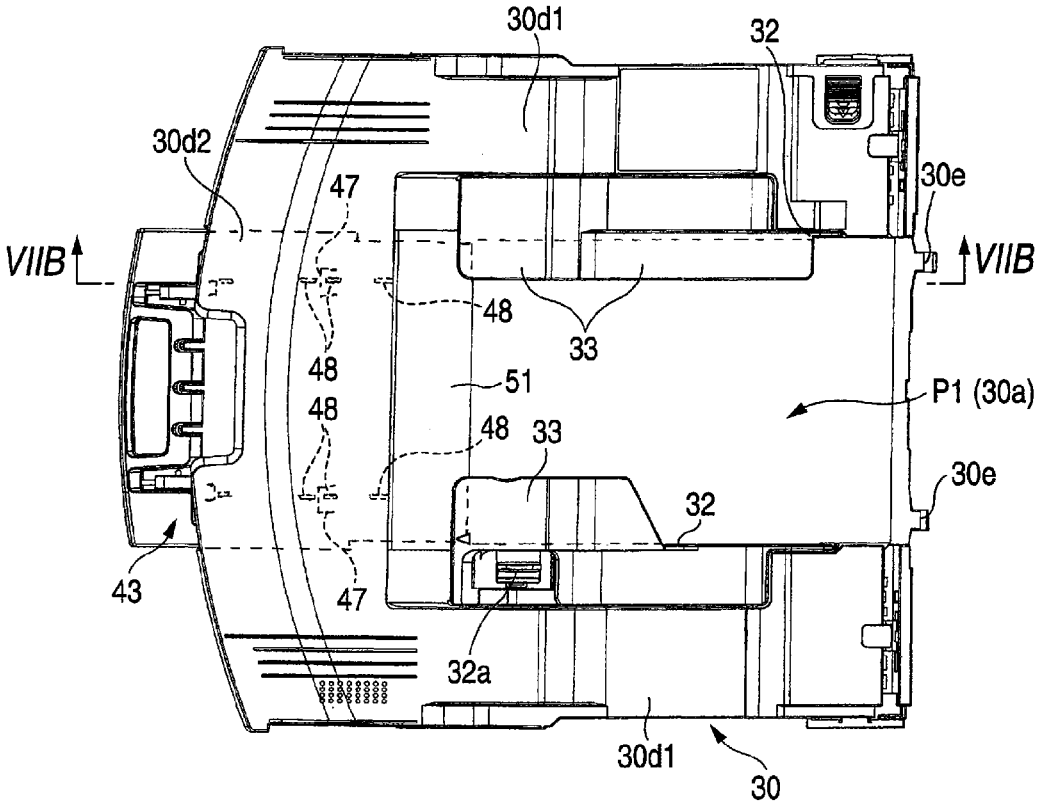
FIG. 7A is a plan view showing only the auxiliary sheet feeding cassette in which 4-inches-by-6-inches sheets P1 have been set.
Figure 7B:
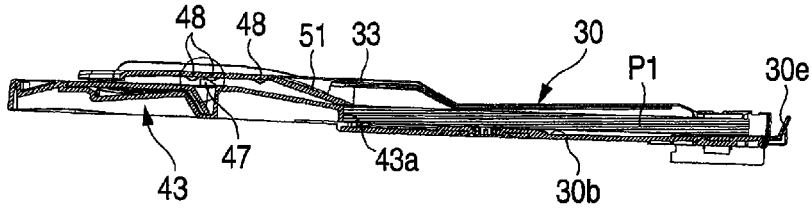
FIG. 7B is a cross-sectional view along line VIIb-VIIb of FIG. 7A.
Figure 7C:
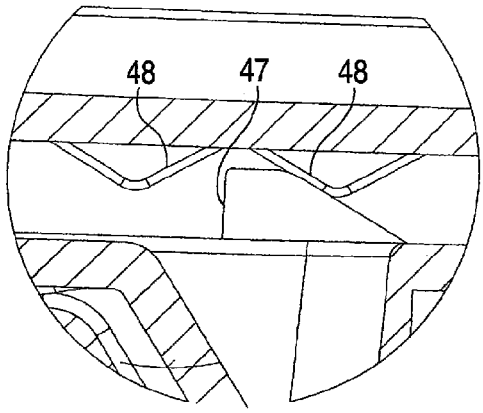
FIG. 7C is an enlarged cross-sectional view of the main part of FIG. 7B.

Note that FIG. 7A to FIG. 7C only show the auxiliary sheet feeding cassette 30 and the auxiliary sheet discharging tray 43.

Touch projections 47 are formed integrally with the upper surface of the auxiliary sheet discharging tray 43 at right and left positions in the middle thereof in the forward and backward direction (see FIG. 6A to FIG. 6C and FIG. 7A to FIG. 7C, for example). A plurality of V-shaped click portions 48 directed downwardly are formed integrally with the corresponding areas of the undersurface of the center placing portion 30*d*2 (in the hollow portion 44) along the backward-forward direction of the touch projections 47 of the auxiliary sheet discharging tray 43 (see FIG. 7A to FIG. 7C, for example). When the auxiliary sheet discharging tray 43 is carried forward or backward, the touch projection 47 comes into contact with or goes beyond the click portion 48 located in a predetermined position, and hence a click sensation generated by this enables the user to know the stopping position according to predetermined sizes of the sheet P1.

Figure 9A:
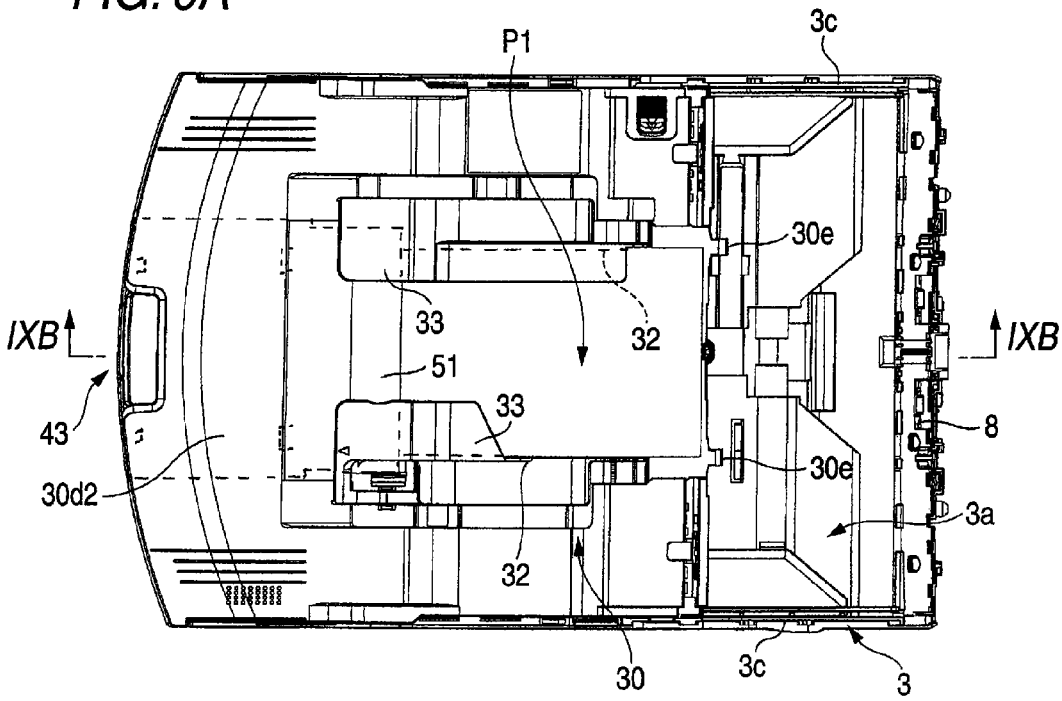
FIG. 9A is a plan view showing a state in which L-size sheets P1 have been set in the auxiliary sheet feeding cassette carried backward from the main sheet feeding cassette.
Figure 9B:
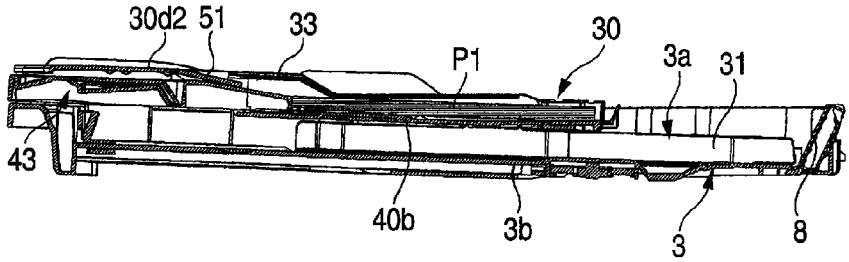
FIG. 9B is a cross-sectional view along line IXb-IXb of FIG. 9A.
Figure 9C:
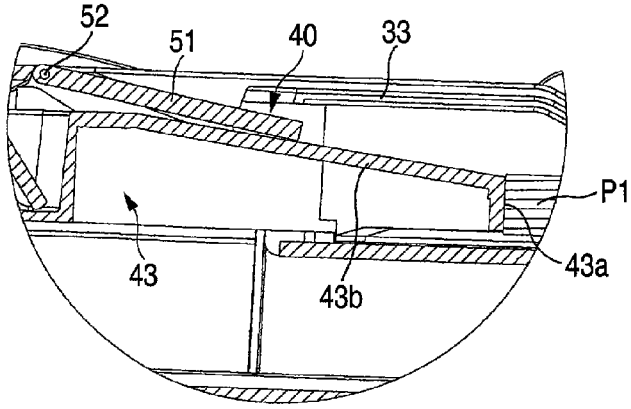
FIG. 9C is an enlarged cross-sectional view of the main part of FIG. 9B.

For example, if a 4-inches-by-6-inches sheet is used as the sheet P1, the touch projection 47 is located between the front and rear click portions 48 midway in the forward and backward direction (see FIG. 7A to FIG. 7C). If an L-size sheet shown in FIG. 9A to FIG. 9C is used as the sheet P1, the stopping position is fixed at a position where the touch projection 47 goes beyond the click portion 48 located on the forward side. Thus, in the sheets having these sizes, the stopping position fixed after the auxiliary sheet discharging tray 43 is moved forwardly and backwardly can be maintained.

A flap 51 having a pivoted portion 52 at the forward end of the center placing portion 30*d*2 is extended toward the inside of the sheet stacking portion 30*a*. The flap 51 can be pivoted upwardly and downwardly. When the auxiliary sheet discharging tray 43 is carried forward, a top plate 43*b* of the auxiliary sheet discharging tray 43 pushes up and rotates the flap 51. As a result, the opening area of the sheet insertion opening 40 is reduced by the flap 51, or the sheet insertion opening 40 is closed thereby (see FIG. 6A to FIG. 6C and FIG. 7A to FIG. 7C). On the other hand, when the auxiliary sheet discharging tray 43 is carried backward, the contact position of the flap 51 with the top plate 43*b* is changed, and the flap 51 is pivoted downwardly. The top plate 43*b* is separated from the undersurface of the flap 51 at the position where the auxiliary sheet discharging tray 43 is carried backward to the utmost. Accordingly, the downward rotational angle of the flap 51 becomes large, and hence the opening area of the sheet insertion opening 40 can be maximized (see FIG. 4A to FIG. 4C).

When the flap 51 is pivoted upwardly and the opening area of the sheet insertion opening 40 is reduced or the sheet insertion opening 40 is closed, a sheet P (P1) to pass through the recording unit 7 and to be discharged is slid on the upper surface of the auxiliary cover portion 33, and the forward end of the sheet P (P1) is smoothly guided onto the center placing portion 30*d*2 without being caught by the sheet insertion opening 40.

In this illustrative aspect, the flap 51 is provided as mentioned above. However, this flap 51 may be removed. In this case, the leading end of a sheet P (P1) to be discharged can be prevented from being caught by the sheet insertion opening 40 by setting the height position of the rear end of the auxiliary cover portion 33 to be higher than the height position of the center placing portion 30*d*2 (in other words, by creating a height difference), or by slightly extending the rear end of the auxiliary cover portion 33 to the upper side of the center placing portion 30*d*2.

FIG. 9A to FIG. 9C show an example in which L-size sheets are used as the sheet P1 to be supplied. As in the example of the 4-inches-by-6-inches sheet, in this example, the auxiliary sheet feeding cassette 30 is pulled out together with the main sheet feeding cassette 3 so that the auxiliary sheet feeding cassette 30 comes out from the insertion opening 2*a* outside the casing 2, and the auxiliary sheet discharging tray 43 is carried backward so as to open the sheet insertion opening 40 in the auxiliary sheet feeding cassette 30 in a state in which the auxiliary sheet feeding cassette 30 has been pulled up to the rear end of the main sheet feeding cassette 3 (i.e., in a non-sheet-feed state). Under this state, a sheet P1 that has been slid on the center placing portion 30*d*2 of the discharged-sheet placing portion 30*d* is inserted from the sheet insertion opening 40 into the sheet stacking portion 30*a*. A bundle of predeterminedly-sized sheets P1 is then inserted into the sheet stacking portion 30*a*, and the auxiliary sheet discharging tray 43 is carried forward. As a result, the forward end plate 43*a* of the auxiliary sheet discharging tray 43 comes into contact with the rear end edge of the sheet P1. Therefore, the auxiliary sheet discharging tray 43 serves as a rear end guide for the sheet P1, thus preventing the sheet P1 from moving backwardly. Thereafter, positions of the right and left side tracks of the sheet P1 are determined while grasping and adjusting the knob 32*a* of the side guide member 32.

When the placing portion 3*a* of the main sheet feeding cassette 3 is replenished with large-sized sheets P with the above-mentioned structure, the main sheet feeding cassette 3 is pulled out together with the auxiliary sheet feeding cassette 30 close to the opening 2*a* of the housing 2, and a bundle of sheets P is then set in the placing portion 3*a* while lifting the rear end of the auxiliary sheet feeding cassette 30.

When large-sized sheets P in the main sheet feeding cassette 3 inserted in the casing 2 are fed to the recording unit 7, the auxiliary sheet feeding cassette 30 is pulled out to the rear side of the main sheet feeding cassette 3 as in FIG. 3, FIG. 4, FIG. 6, and FIG. 9 so that the feed roller 6*b* can press the uppermost one of the sheets stacked and placed on the placing portion 3*a*. When the feed roller 6*b* is driven under this state according to a print command, only the uppermost sheet P is separated and fed by the separation pad 8*a* of the inclined separation plate 8. This sheet P passes through a gap between the inner surface side (inner diameter side) of the outer-diameter conveying path body 35 and the outer surface side (outer diameter side) of the inner-diameter conveying path body 36. Thereafter, the forward end edge of the sheet is brought into contact with the registration roller pair 27 rotating reversely, and is subjected to a registration action.

Thereafter, the registration roller pair 27 is positively rotated, and thereby the sheet is conveyed (fed) toward the recording unit 7 while the sheet is being sandwiched between the elements of the registration roller pair 27.

Figure 8A:
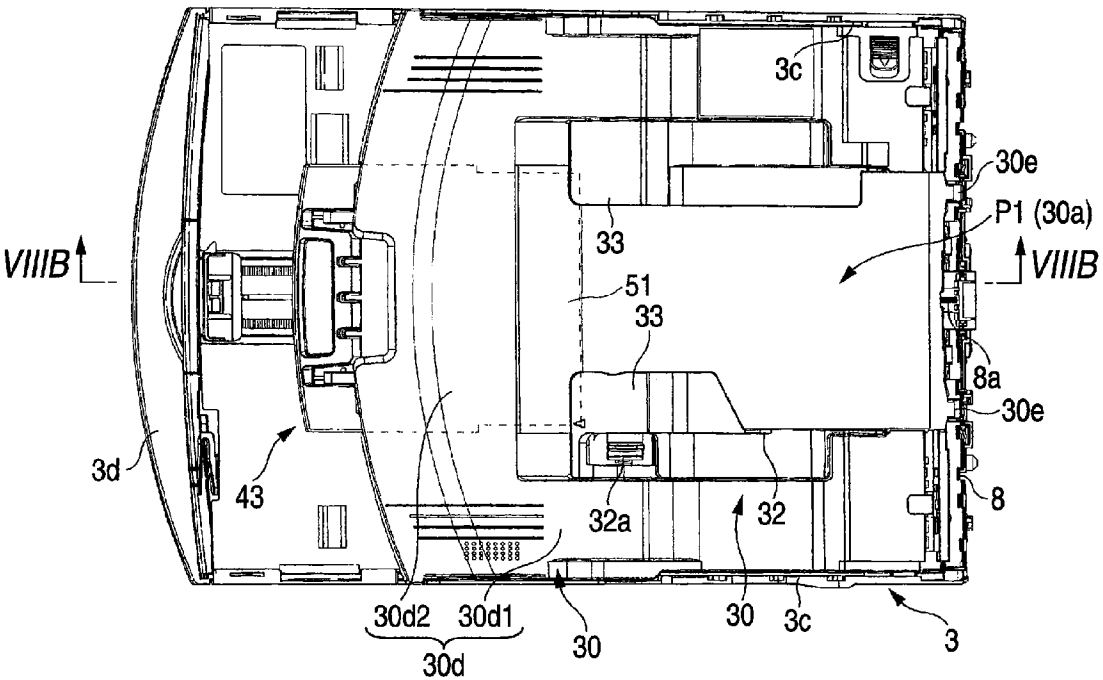
FIG. 8A is a plan view showing a state in which 4-inches-by-6-inches sheets P1 have been set in the auxiliary sheet feeding cassette, and the auxiliary sheet feeding cassette has been placed at a sheet feed position.
Figure 8B:
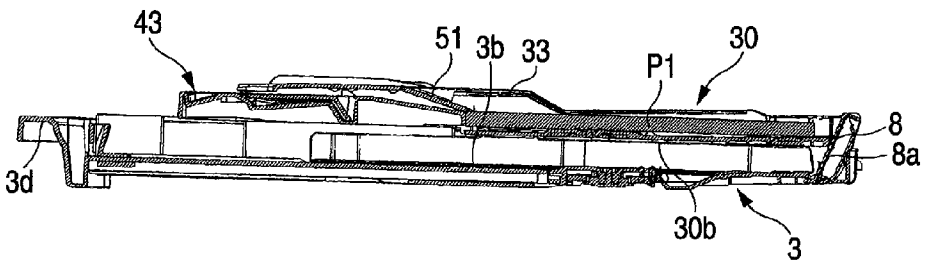
FIG. 8B is a cross-sectional view along line VIIb-VIIb of FIG. 8A.
Figure 10A:
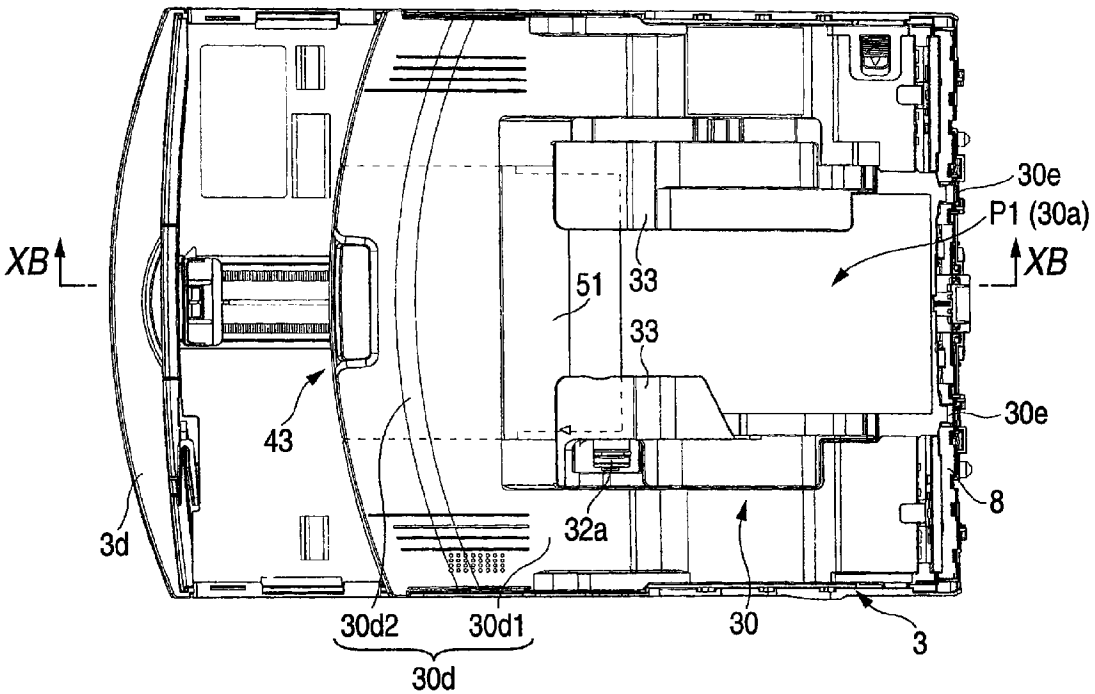
FIG. 10A is a plan view showing a state in which L-size sheets P1 have been set in the auxiliary sheet feeding cassette, and the auxiliary sheet feeding cassette has been placed at a sheet feed position.
Figure 10B:
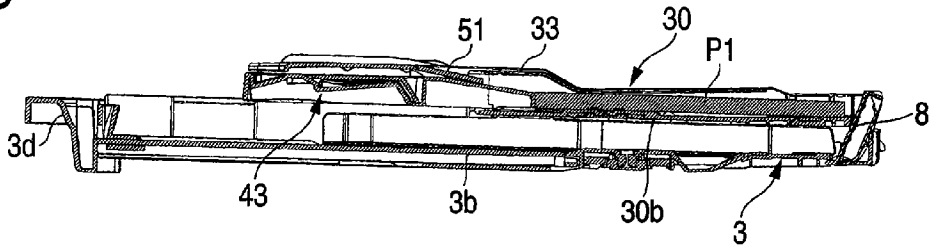
FIG. 10B is a cross-sectional view along line Xb-Xb of FIG. 10A.

When an image is printed on a sheet P1 small in width, such as a postcard, the auxiliary sheet feeding cassette 30 is pushed toward the depth side of the main sheet feeding cassette 3. (FIG. 8A and FIG. 8B show an example of a 4-inches-by-6-inches sheet P1, whereas FIG. 10A and FIG. 10B show an example of an L-size sheet P1.) As a result, the forward end edge of the auxiliary sheet feeding cassette 30 reaches a state of being in contact with the inclined separation plate 8, so that the feed roller 6*b* can press the uppermost one of the sheets P1 stacked on the sheet stacking portion 30*a* in the auxiliary sheet feeding cassette 30. When the feed roller 6*b* is driven under this state according to a print command, only the uppermost sheet P1 is separated and fed by the separation pad 8*a* of the inclined separation plate 8. This sheet P1 passes through a large gap between the inner surface side (inner diameter side) of the outer-diameter conveying path body 35 and the inner-diameter conveying path body 36. Thereafter, the leading end of the sheet P1 is brought into contact with the registration roller pair 27 rotating reversely, and is subjected to a registration action.

Thereafter, the registration roller pair 27 is positively rotated, and thereby the sheet is conveyed (fed) toward the recording unit 7 while the sheet P1 is being sandwiched between the elements of the registration roller pair 27.

The main sheet feeding cassette 3, the auxiliary sheet feeding cassette 30, the side guide member 31, the auxiliary cover portion 33, the auxiliary sheet discharging tray 43, the flap 51, etc., can be made of synthetic resin in the illustrative aspect of the present invention.

The present invention can be, as a matter of course, applied to a structure in which the placing portion 3*a* of the main sheet feeding cassette 3 and the sheet stacking portion 30*a* of the auxiliary sheet feeding cassette 30 are disposed on the side of one side plate of each cassette 3 (30) in a biased manner, whereas only the single guide member 31 (32) is disposed at the side of the other side plate.

According to one aspect, the main sheet feeding cassette includes the placing portion on which many sheets of recording media can be stacked, and the auxiliary sheet feeding cassette includes the sheet-setting portion that is disposed movably to and from the main sheet feeding cassette on the placing portion of the main sheet feeding cassette and on which a plurality of recording media smaller in size in a width direction perpendicular to the sheet-feed direction than the recording medium placed on the main sheet feeding cassette can be stacked. Therefore, the structure of the present invention can be made more compact than a structure in which two-stage type upper and lower sheet feeding cassettes are moved independently of each other toward and from different insertion openings of a casing of an image recording apparatus.

Additionally, in the image recording apparatus according to the first aspect of the present invention, the auxiliary sheet feeding cassette is disposed so as to be movable to and from the main sheet feeding cassette in the feed direction of the recording medium on a placing portion in the main sheet feeding cassette. The auxiliary sheet feeding cassette includes a sheet stacking portion capable of stacking a plurality of recording media smaller in size in a width direction perpendicular to the feed direction than the recording medium in the main sheet feeding cassette, and a discharged-sheet placing portion contiguous to the sheet stacking portion on an upstream side in the feed direction. An auxiliary cover portion on which recording media to be discharged from the sheet conveying path through the image recording unit are placed is disposed above the sheet stacking portion. A sheet insertion opening that communicates with an end on an upstream side in the feed direction of the sheet stacking portion is formed between an end on the upstream side in the feed direction of the auxiliary cover portion and the discharged-sheet placing portion. An auxiliary sheet discharging tray is disposed on a side of an undersurface of the discharged-sheet placing portion at a rear of the auxiliary sheet feeding cassette so that the auxiliary sheet discharging tray is movable to and from the sheet insertion opening. A forward end of the auxiliary sheet discharging tray serves as a rear end guide for recording media stacked on the sheet stacking portion at a position where the auxiliary sheet discharging tray carried forward.

According to this structure, the sheet insertion opening is greatly opened toward the rear end of the sheet stacking portion merely by allowing the auxiliary sheet discharging tray to recede therefrom when the sheet stacking portion of the auxiliary sheet feeding cassette is replenished with recording media (sheets). Recording media can be inserted through the thus opened sheet insertion opening into the sheet stacking portion from the side of the discharged-sheet placing portion that is a rear side of the auxiliary sheet feeding cassette. Therefore, advantageously, recording media can be fairy easily supplied according to the present invention, unlike a conventional apparatus in which much time is consumed to supply recording media after each main sheet feeding cassette is pulled out from the apparatus body.

Moreover, the forward end of the auxiliary sheet discharging tray can be used as a rear end guide for recording media stacked on the sheet stacking portion merely by pushing the auxiliary sheet discharging tray toward the inside of the auxiliary sheet feeding cassette after inserting the recording media into the sheet stacking portion. Therefore, a positional deviation does not occur in the recording media stacked thereon. Thus, the role of the auxiliary sheet discharging tray can be changed by the forward position and the backward position of the auxiliary sheet discharging tray, and, advantageously, the structure for this becomes extremely simple.

The auxiliary sheet feeding cassette may have a flap with which the sheet feed opening can be covered and which is pivotably attached to the auxiliary sheet feeding cassette. Therefore, advantageously, in addition to the effect of the first aspect of the present invention, a recording medium on which image data or the like have been recorded does not enter the sheet stacking portion in error, and this does not cause a paper jam when a recording medium is discharged toward the discharged-sheet placing portion that is located on the rear side of the auxiliary sheet feeding cassette.

Preferably, the flap is upwardly moved by an forward movement of the auxiliary sheet discharging tray in a direction in which the sheet feed opening is closed, and is downwardly moved by a backward movement of the auxiliary sheet discharging tray in a direction in which the sheet feed opening is opened. Therefore, the flap can be upwardly opened or downwardly closed by an forward movement or a backward movement of the auxiliary sheet discharging tray, and hence other operating members are not required, thus making the structure simple.

A pair of right and left auxiliary cover portions may be disposed so as to be adjusted widely or narrowly in a width direction perpendicular to the feed direction at a place where the sheet stacking portion is disposed. Therefore, a recording medium to be discharged after completion of a recording operation is never mixed with recording media placed on the sheet stacking portion, and can be guided and discharged toward the discharged-sheet placing portion in the auxiliary sheet feeding cassette. Additionally, a path used for a recording medium placed on the sheet stacking portion and a path used for a to-be-discharged recording medium on which image data or the like have been recorded are partitioned by the pair of right and left auxiliary cover portions so as to be used as an upper path and a lower path, and hence the recording media placed on the sheet stacking portion can be prevented from being soiled.

A positioning member for an forward position or a backward position of the auxiliary sheet discharging tray may be provided. Therefore, advantageously, once the position of the auxiliary sheet discharging tray is determined, this position can be maintained, and recording media stacked on the sheet stacking portion are not positionally deviated.

Preferably, the recording media placed in the main and auxiliary sheet feeding cassettes are sent out by a common sheet feed unit, and are separated one by one at least by an inclined separation plate provided at an end of the main sheet feeding cassette, and are conveyed upwardly with respect to the sheet conveying path. Therefore, advantageously, the structure of the sheet feed unit can be made simple, and an image-recording operation can be performed smoothly and reliably.

What is claimed is:

1. An image recording apparatus comprising:

an image recording unit configured to record an image on a recording medium;

a first sheet feeding cassette disposed below the image recording unit and movable substantially along a first direction, the first sheet feeding cassette comprising a first placing portion on which a recording medium is allowed to be placed;

a second sheet feeding cassette disposed on and attached to the first sheet feeding cassette and movable substantially along the first direction with respect to the first sheet feeding cassette, the second sheet feeding cassette comprising:

a second placing portion on which a recording medium is allowed to be placed; and a discharged sheet placing portion disposed an upstream side of the second placing portion with respect to the first direction;

a sheet feed unit configured to selectively feed the recording medium placed in the first sheet feeding cassette and the second sheet feeding cassette in the first direction toward the image recording unit via a sheet conveying path;

an auxiliary cover portion disposed above the second placing portion, on which the recording medium discharged from the image recording unit is allowed to be placed; and an auxiliary sheet discharging tray that is disposed below the discharged sheet placing portion, wherein a sheet insertion opening is formed between an upstream end of the auxiliary cover portion with respect to the first direction and the discharged sheet placing portion and communicates with an upstream side of the second placing portion with respect to the first direction, and wherein the auxiliary sheet discharging tray is movable in a forward direction and a rearward direction opposite to the forward direction, with respect to the sheet insertion opening, and a forward end of the auxiliary sheet discharging tray is configured to abut on a tail end of the recording medium placed on the second placing portion.

2. The image recording apparatus according to claim 1, wherein a first recording medium is allowed to be placed on the first placing portion, wherein a second recording medium is allowed to be placed on the second placing portion, wherein the second recording medium is smaller in size in a width direction perpendicular to the first direction than the first recording medium.

3. The image recording apparatus according to claim 1, wherein the second placing portion allows thereon a stack of a plurality sheets of the recording media to be placed, wherein the stack is allowed to be inserted in the sheet insertion opening.

4. The image recording apparatus according to claim 1, wherein a forward end of the auxiliary sheet discharging tray is movable to a position that defines a tail end of the recording medium having a predetermined size placed on the second placing portion.

5. The image recording apparatus according to claim 1, wherein the second sheet feeding cassette comprises a flap pivotably attached to the second sheet feeding cassette and capable of covering the sheet insertion opening.

6. The image recording apparatus according to claim 5, wherein the flap is upwardly moved by a forward movement of the auxiliary sheet discharging tray in a direction in which the sheet insertion opening is closed, and is downwardly moved by a rearward movement of the auxiliary sheet discharging tray in a direction in which the sheet insertion opening is opened.

7. The image recording apparatus according to claim 5, wherein the flap has a first end pivotably attached to the auxiliary cover portion and a second end that is a free end movable between a first position below the sheet insertion opening and a second position higher than the first position, wherein when the second end of the flap is positioned at the first position, the second end is located in a path on which the auxiliary sheet discharging tray is movable, wherein the second end of the flap is upwardly moved when the auxiliary sheet discharging tray contacts with the flap.

8. The image recording apparatus according to claim 1, wherein the auxiliary cover portion comprises a pair of auxiliary cover members that are disposed to be separated with each other in a second direction perpendicular to the feed direction and movable to adjust a distance between the auxiliary cover members in the second direction to define a size of the recording medium to be placed on the second placing portion.

9. The image recording apparatus according to claim 1, further comprising a positioning member for a position of the auxiliary sheet discharging tray in the forward and rearward direction.

10. The image recording apparatus according to claim 9, wherein the positioning member comprises:

a first positioning member provided on a lower surface of the discharged sheet placing portion; and a second positioning member provided on an upper surface of the auxiliary sheet discharging tray and abut on the first positioning member when the second positioning member is positioned at a predetermined position.

11. The image recording apparatus according to claim 1, wherein the recording media placed on the first and second sheet feeding cassettes are fed by the sheet feed unit, and wherein the recording media is separated one by one by an inclined separation plate provided in a vicinity of an end of the main sheet feeding cassette and is conveyed upwardly with respect to the sheet conveying path.

12. The image recording apparatus according to claim 1, wherein the sheet conveying path has a substantially U-shaped section, and wherein the recording medium fed by the sheet feed unit is conveyed into the U-shaped section, output from the U-shaped section in an output direction substantially opposite to the first direction, entered into the image recording unit, and discharged from the image recording unit in the output direction.

13. An image recording apparatus comprising:

an image recording unit configured to record an image on a recording medium;

a first sheet feeding cassette disposed below the image recording unit and movable substantially along a first direction, the first sheet feeding cassette comprising a first placing portion on which a recording medium is allowed to be placed;

a second sheet feeding cassette disposed on and attached to the first sheet feeding cassette and movable substantially along the first direction with respect to the first sheet feeding cassette, the second sheet feeding cassette comprising:

a second placing portion on which a recording medium is allowed to be placed; and a discharged sheet placing portion disposed an upstream side of the second placing portion with respect to the first direction;

a sheet feed unit configured to selectively feed the recording medium placed in the first sheet feeding cassette and the second sheet feeding cassette in the first direction toward the image recording unit via a sheet conveying path;

an auxiliary cover portion disposed above the second placing portion, on which the recording medium discharged from the image recording unit is allowed to be placed; and an auxiliary sheet discharging tray that is disposed below the discharged sheet placing portion, wherein a sheet insertion opening is formed between an upstream end of the auxiliary cover portion with respect to the first direction and the discharged sheet placing portion and communicates with an upstream side of the second placing portion with respect to the first direction, and wherein the auxiliary sheet discharging tray is movable in a forward direction and a rearward direction opposite to the forward direction, with respect to the sheet insertion opening, and a forward end of the auxiliary sheet discharging tray is movable to a position that defines a tail end of the recording medium having a predetermined size placed on the second placing portion.

14. An image recording apparatus comprising:

an image recording unit configured to record an image on a recording medium;

a first sheet feeding cassette disposed below the image recording unit and movable substantially along a first direction, the first sheet feeding cassette comprising a first placing portion on which a recording medium is allowed to be placed;

a second sheet feeding cassette disposed on and attached to the first sheet feeding cassette and movable substantially along the first direction with respect to the first sheet feeding cassette, the second sheet feeding cassette comprising:

a second placing portion on which a recording medium is allowed to be placed; and a discharged sheet placing portion disposed an upstream side of the second placing portion with respect to the first direction;

a sheet feed unit configured to selectively feed the recording medium placed in the first sheet feeding cassette and the second sheet feeding cassette in the first direction toward the image recording unit via a sheet conveying path;

an auxiliary cover portion disposed above the second placing portion, on which the recording medium discharged from the image recording unit is allowed to be placed; and an auxiliary sheet discharging tray that is disposed below the discharged sheet placing portion, wherein a sheet insertion opening is formed between an upstream end of the auxiliary cover portion with respect to the first direction and the discharged sheet placing portion and communicates with an upstream side of the second placing portion with respect to the first direction;

wherein the auxiliary sheet discharging tray is movable in a forward direction and a rearward direction opposite to the forward direction, with respect to the sheet insertion opening; and wherein the second sheet feeding cassette further comprises a flap pivotably attached to the second sheet feeding cassette and configured to the sheet insertion opening, and the flap comprises a first end pivotably attached to the auxiliary cover portion and a second end that is a free end movable between a first position below the sheet insertion opening and a second position higher than the first position, wherein when the second end of the flap is positioned at the first position, the second end is located in a path on which the auxiliary sheet discharging tray is movable, wherein the second end of the flap is upwardly moved when the auxiliary sheet discharging tray contacts with the flap.

15. An image recording apparatus comprising:

an image recording unit configured to record an image on a recording medium;

a first sheet feeding cassette disposed below the image recording unit and movable substantially along a first direction, the first sheet feeding cassette comprising a first placing portion on which a recording medium is allowed to be placed;

a second sheet feeding cassette disposed on and attached to the first sheet feeding cassette and movable substantially along the first direction with respect to the first sheet feeding cassette, the second sheet feeding cassette comprising:

a second placing portion on which a recording medium is allowed to be placed; and a discharged sheet placing portion disposed an upstream side of the second placing portion with respect to the first direction;

a sheet feed unit configured to selectively feed the recording medium placed in the first sheet feeding cassette and the second sheet feeding cassette in the first direction toward the image recording unit via a sheet conveying path;

an auxiliary cover portion disposed above the second placing portion, on which the recording medium discharged from the image recording unit is allowed to be placed, wherein the auxiliary cover portion comprises a pair of auxiliary cover members that are disposed to be separated with each other in a second direction perpendicular to the feed direction and movable to adjust a distance between the auxiliary cover members in the second direction to define a size of the recording medium to be placed on the second placing portion; and an auxiliary sheet discharging tray that is disposed below the discharged sheet placing portion, wherein a sheet insertion opening is formed between an upstream end of the auxiliary cover portion with respect to the first direction and the discharged sheet placing portion and communicates with an upstream side of the second placing portion with respect to the first direction, and wherein the auxiliary sheet discharging tray is movable in a forward direction and a rearward direction opposite to the forward direction, with respect to the sheet insertion opening.

16. An image recording apparatus comprising:

an image recording unit configured to record an image on a recording medium;

a first sheet feeding cassette disposed below the image recording unit and movable substantially along a first direction, the first sheet feeding cassette comprising a first placing portion on which a recording medium is allowed to be placed;

a second sheet feeding cassette disposed on and attached to the first sheet feeding cassette and movable substantially along the first direction with respect to the first sheet feeding cassette, the second sheet feeding cassette comprising:

a second placing portion on which a recording medium is allowed to be placed; and a discharged sheet placing portion disposed an upstream side of the second placing portion with respect to the first direction;

a sheet feed unit configured to selectively feed the recording medium placed in the first sheet feeding cassette and the second sheet feeding cassette in the first direction toward the image recording unit via a sheet conveying path;

an auxiliary cover portion disposed above the second placing portion, on which the recording medium discharged from the image recording unit is allowed to be placed; and an auxiliary sheet discharging tray that is disposed below the discharged sheet placing portion, wherein a sheet insertion opening is formed between an upstream end of the auxiliary cover portion with respect to the first direction and the discharged sheet placing portion and communicates with an upstream side of the second placing portion with respect to the first direction, and wherein the auxiliary sheet discharging tray is movable in a forward direction and a rearward direction opposite to the forward direction, with respect to the sheet insertion opening, and is movable to a position at which a forward end of the auxiliary sheet discharging tray is located within the second placing portion of the second sheet feeding cassette.

* * * * *